US010292468B2

(12) United States Patent
You

(10) Patent No.: US 10,292,468 B2
(45) Date of Patent: May 21, 2019

(54) AUTOMATIC OPENING OR CLOSING UMBRELLA

(71) Applicant: Ching-Chuan You, Taipei (TW)

(72) Inventor: Ching-Chuan You, Taipei (TW)

( * ) Notice: Subject to any disclaimer, the term of this patent is extended or adjusted under 35 U.S.C. 154(b) by 0 days.

(21) Appl. No.: 15/652,265

(22) Filed: Jul. 18, 2017

(65) Prior Publication Data

US 2019/0021460 A1 Jan. 24, 2019

(51) Int. Cl.
*A45B 25/16* (2006.01)
*A45B 25/14* (2006.01)
*A45B 25/22* (2006.01)

(52) U.S. Cl.
CPC ..... *A45B 25/143* (2013.01); *A45B 25/16* (2013.01); *A45B 25/22* (2013.01)

(58) Field of Classification Search
CPC ..... A45B 25/02; A45B 25/143; A45B 25/16; A45B 25/14; A45B 9/02; A45B 25/006; A45B 25/22
USPC ..... 135/25.4, 22–24, 27–32
See application file for complete search history.

(56) References Cited

U.S. PATENT DOCUMENTS

| | | | | | |
|---|---|---|---|---|---|
| 4,936,332 | A * | 6/1990 | Wu | A45B 25/143 | 135/20.3 |
| 5,144,969 | A * | 9/1992 | Chou | A45B 25/143 | 135/22 |
| 5,441,065 | A * | 8/1995 | Lin | A45B 25/143 | 135/20.3 |
| 5,632,290 | A * | 5/1997 | Ling Kuo | A45B 25/143 | 135/24 |
| 5,803,102 | A * | 9/1998 | Ko | A45B 25/143 | 135/22 |
| 5,868,151 | A * | 2/1999 | Kuo | A45B 25/143 | 135/22 |
| 6,173,722 | B1 * | 1/2001 | Ko | A45B 25/143 | 135/22 |
| 7,735,498 | B2 * | 6/2010 | You | A45B 25/143 | 135/24 |
| 2008/0135075 | A1 * | 6/2008 | Parisi | A45B 11/00 | 135/22 |

* cited by examiner

*Primary Examiner* — Winnie Yip

(57) ABSTRACT

An automatic non-collapsible umbrella includes a handle, a control mechanism, a center post, a detent mechanism, a runner assembly, and a skeleton. A cylindrical main seat of the control mechanism includes a spring biased open button for opening the umbrella, and a spring biased collapse button adjacent to the collapse button for closing the umbrella.

19 Claims, 14 Drawing Sheets

AUTOMATIC OPENING OR CLOSING UMBRELLA

BACKGROUND OF THE INVENTION

1. Field of the Invention

The invention relates to automatic umbrellas and more particularly to an automatic non-collapsible umbrella and method of opening or closing same by providing a first spring for opening the umbrella and a second spring for closing the umbrella respectively.

2. Description of Related Art

Umbrellas are primarily hand-held portable devices sized for personal use. Umbrellas can be divided into two categories: fully collapsible umbrellas, in which the metal pole supporting the canopy retracts, and non-collapsible umbrellas, in which the support pole cannot retract and only the canopy can be collapsed. Another distinction can be made between manually operated umbrellas and spring loaded automatic umbrellas is that the latter can be open at the press of a button.

For an automatic umbrella, its spring is taken as drive means for opening or closing the umbrella. The elastic force grows as the length of the pole increases. Thus, difficulties increase in the manufacturing process of an automatic umbrella as the length of the pole increases. Further, an upper elastic limit member, a lower elastic limit member, and an intermediate spring-loaded ball detent are required components. However, they are prone to malfunction due to elastic fatigue after a period of time of use. Furthermore, the spring is greatly enhanced to facilitate its opening or closing. This, however, can hurt a user if sufficient care is not taken in use.

Thus, the need for improvement still exists.

SUMMARY OF THE INVENTION

For achieving above and other objects, an automatic non-collapsible umbrella comprising a center post, a runner assembly mounted on the center post and including a lower sleeve seat, a slotted intermediate ring, and a top grommet and a skeleton mounted on the runner assembly, wherein the center post includes a support tube with a control mechanism mounted thereon, the control mechanism including a cylindrical main seat and a cylindrical control seat, the support tube further with a detent mechanism mounted thereon, the detent mechanism including a rod member and a collapse biasing member; the runner assembly further includes a stretch biasing member biased between the lower sleeve seat and the slotted intermediate ring; the cylindrical control seat includes a front opening on a circumferential surface, and a rear opening disposed on the circumferential surface with a mount member disposed thereon; the cylindrical main seat includes a window on a circumferential surface and corresponding to the front opening, an open button in the window for opening the automatic non-collapsible umbrella, and a collapse button in the window for closing the automatic non-collapsible umbrella; the mount member includes a recess on an inner surface, and a receptacle in the recess with a biasing member mounted therein wherein a lower resistance member is disposed in the cylindrical control seat to push the biasing member rearward to urge against the receptacle, and the collapse button is disposed on the lower resistance member; the center post further includes a rod in the support tube; the rod member passes through an enhancement tube to fasten at a top end of the enhancement tube; a bottom end of the rod member passes through the lower resistance member to dispose in the rod; the collapse biasing member has a top urging against a bottom of the enhancement tube and a bottom urging against a top of the rod so that the collapse biasing member is biased between the enhancement tube and the rod; and in an open state of the automatic non-collapsible umbrella in response to pressing the collapse button to push the lower resistance member inward to cause the lower resistance member to unblock the rod member, the stored elastic force of the collapse biasing member is released to urge its top against and push up the enhancement tube, and the top grommet moves upward, thereby closing the skeleton.

According to an embodiment of the present invention, wherein the support tube includes an opening, the rod includes a top hole and an opening aligned with the opening and communicating with the top hole, the lower resistance member includes a protrusion on an inner surface urging the biasing member, and the protrusion passes through the opening of the support tube and the opening of the rod to secure the lower resistance member, the support tube, the rod, and the rod member together.

According to an embodiment of the present invention, wherein the rod member includes a bottom enlargement disposed in the top hole of the rod, and a top of the bottom enlargement is stopped by the protrusion.

According to an embodiment of the present invention, wherein the enhancement tube includes a lower enlargement urging against the collapse biasing member.

According to an embodiment of the present invention, wherein the center post further includes an inner tube laced on the enhancement tube, the enhancement tube includes a lower enlargement with the inner tube positioned thereon, and the rod member includes an inverted U-shaped hook on a top fastened at tops of both the inner tube and the enhancement tube.

According to an embodiment of the present invention, wherein the lower enlargement has a multiple-sided section.

According to an embodiment of the present invention, wherein the runner assembly further includes an intermediate ring and a hollow extension atop of the enhancement tube and placed on the top grommet; the skeleton includes a plurality of ribs, a plurality of primary stretchers, and a plurality of secondary stretchers; the rib has one end pivotably attached to the top grommet; the primary stretcher has one end pivotably attached to the intermediate ring; and in response to moving the lower sleeve seat downward, both the ribs and the primary stretchers pivotably move toward the center post.

According to an embodiment of the present invention, wherein the rib includes an intermediate connecting member, a plurality of adjustment rods each having one pivotably attached to a joining portion of the primary stretcher and the secondary stretcher, and a plurality of auxiliary biasing members each having one end attached to a lower end of the connecting member and the other end attached to the other end of the adjustment rod, the auxiliary biasing member being configured to exert an elastic force on the rib; and wherein in response to moving the lower sleeve seat downward, both the ribs and the primary stretchers pivotably move toward the center post with the intermediate ring moving downward and the auxiliary biasing members being compressed.

In a second aspect of the invention there is provided an automatic non-collapsible umbrella comprising a center post, a runner assembly mounted on the center post and including a lower sleeve seat, a slotted intermediate ring, and a top grommet, and a skeleton mounted on the runner assembly, wherein the center post includes a support tube with a control mechanism mounted thereon, the control mechanism including a cylindrical main seat and a cylindrical control seat; the runner assembly further includes a stretch biasing member biased between the lower sleeve seat and the slotted intermediate ring; the cylindrical control seat includes a front opening on a circumferential surface, and a rear opening disposed on the circumferential surface with a mount member disposed thereon; the cylindrical main seat includes a window on a circumferential surface and corresponding to the front opening, an open button in the window for opening the automatic non-collapsible umbrella; the cylindrical control seat further includes the front opening on a circumferential surface, a biasing element having one end anchored in a receptacle on an inner surface of the cylindrical control seat, and the other end urging against an upper resistance member; the lower sleeve seat includes an annular flange on a bottom, the annular flange being stopped by the upper resistance member; and the open button is secured to the upper resistance member, in a closed state of the automatic non-collapsible umbrella in response to pressing the open button to push the closed upper resistance member inward to cause the upper resistance member to unblock the annular flange, the stored elastic force of the stretch biasing member is released to push the top grommet and the slotted intermediate ring further apart, thereby opening the skeleton.

According to an embodiment of the present invention, further comprising two first limit tubes between the top grommet and the slotted intermediate ring, and an annular flange provided on a top of a support tube for supporting the first limiting tubes from below.

According to an embodiment of the present invention, wherein the skeleton includes a plurality of ribs, a plurality of primary stretchers, and a plurality of secondary stretchers; the rib has one end pivotably attached to the top grommet; the primary stretcher has one end pivotably attached to the intermediate ring; and in response to moving the lower sleeve seat upward, both the ribs and the primary stretchers pivotably move away from the center post.

According to an embodiment of the present invention, further comprising two sets of first and second limit tubes between the top grommet and the slotted intermediate ring.

According to an embodiment of the present invention, wherein the rib includes an intermediate connecting member, a plurality of adjustment rods each having one pivotably attached to a joining portion of the primary stretcher and the secondary stretcher, and a plurality of auxiliary biasing members each having one end attached to a lower end of the connecting member and the other end attached to the other end of the adjustment rod, the auxiliary biasing member being configured to exert an elastic force on the rib; and wherein in response to pivotably moving the ribs away from the center post the auxiliary biasing members are expanded.

According to an embodiment of the present invention, wherein the main seat includes a longitudinal groove on a circumferential surface of the main seat, the cylindrical control seat includes a longitudinal projection on the circumferential surface of the cylindrical control seat, and the longitudinal projection is fitted in the longitudinal groove to fasten the cylindrical control seat and the main seat together.

According to an embodiment of the present invention, wherein the main seat includes a cylindrical bottom extension having a decreased diameter, and a pin; the cylindrical control seat includes a cylindrical bottom extension having a decrease diameter; the support tube has a lower portion inserted into the cylindrical control seat which is disposed in the main seat; and the pin is inserted through the main seat, the cylindrical control seat, the support tube, and the rod to fasten them together in a handle.

In a third aspect of the invention there is provided an automatic non-collapsible umbrella comprising a center post, a runner assembly mounted on the center post and including a lower sleeve seat, a slotted intermediate ring, and a top grommet, and a skeleton mounted on the runner assembly, wherein the center post includes a support tube with a control mechanism mounted thereon, the control mechanism including a cylindrical main seat, a cylindrical control seat, an open button for opening the automatic non-collapsible umbrella, a collapse button closing the automatic non-collapsible umbrella, an upper resistance member secured to the open button, and a lower resistance member secured to the collapse button; the support tube is further provided with a detent mechanism mounted thereon; the detent mechanism includes a rod member and a collapse biasing member, the rod member disposed through the support tube and the collapse biasing member and further through the lower resistance member with the collapse biasing member biased in the support tuber; the runner assembly further includes a stretch biasing member biased between the lower sleeve seat and the slotted intermediate ring, and an annular flange on a bottom, the annular flange being fastened in the upper resistance member; in a closed state of the automatic non-collapsible umbrella in response to pressing the open button to push the upper resistance member inward to unblock the lower sleeve seat, the stored elastic force of the stretch biasing member is released to push the lower sleeve seat further away from the slotted intermediate ring, thereby opening the skeleton; and in an open state of the automatic non-collapsible umbrella in response to pressing the collapse button to push the lower resistance member inward to cause the lower resistance member to unblock the rod member, the stored elastic force of the collapse biasing member is released to urge its top against and pushes up an enhancement tube, and the top grommet moves upward, thereby closing the skeleton.

According to an embodiment of the present invention, wherein the stretch biasing member is put on the support tube, the collapse biasing member is disposed in the support tube, and the stretch biasing member and the collapse biasing member operate independently so that required force to open or close the automatic non-collapsible umbrella is decreased to a minimum.

According to an embodiment of the present invention, wherein an outer diameter of the collapse biasing member is substantially matched to an inner diameter of the support tube.

According to an embodiment of the present invention, wherein the runner assembly further includes the intermediate ring and a hollow extension atop of the enhancement tube and placed on the top grommet; the skeleton includes a plurality of ribs, a plurality of primary stretchers, and a plurality of secondary stretchers; the rib has one end pivotably attached to the top grommet; the primary stretcher has one end pivotably attached to the intermediate ring; the rib includes an intermediate connecting member, a plurality of adjustment rods each having one end pivotably attached to a joining portion of the primary stretcher and the secondary stretcher, and a plurality of auxiliary biasing members each having one end attached to a lower end of the connecting member and the other end attached to the other end of the adjustment rod, the auxiliary biasing member being configured to exert an elastic force on the rib; and in response to moving the lower sleeve seat downward, both the ribs and the primary stretchers pivotably move toward the center post with the intermediate ring moving downward and the auxiliary biasing members being compressed.

The above and other objects, features and advantages of the invention will become apparent from the following detailed description taken with the accompanying drawings.

DETAILED DESCRIPTION OF THE INVENTION

Figure 1:
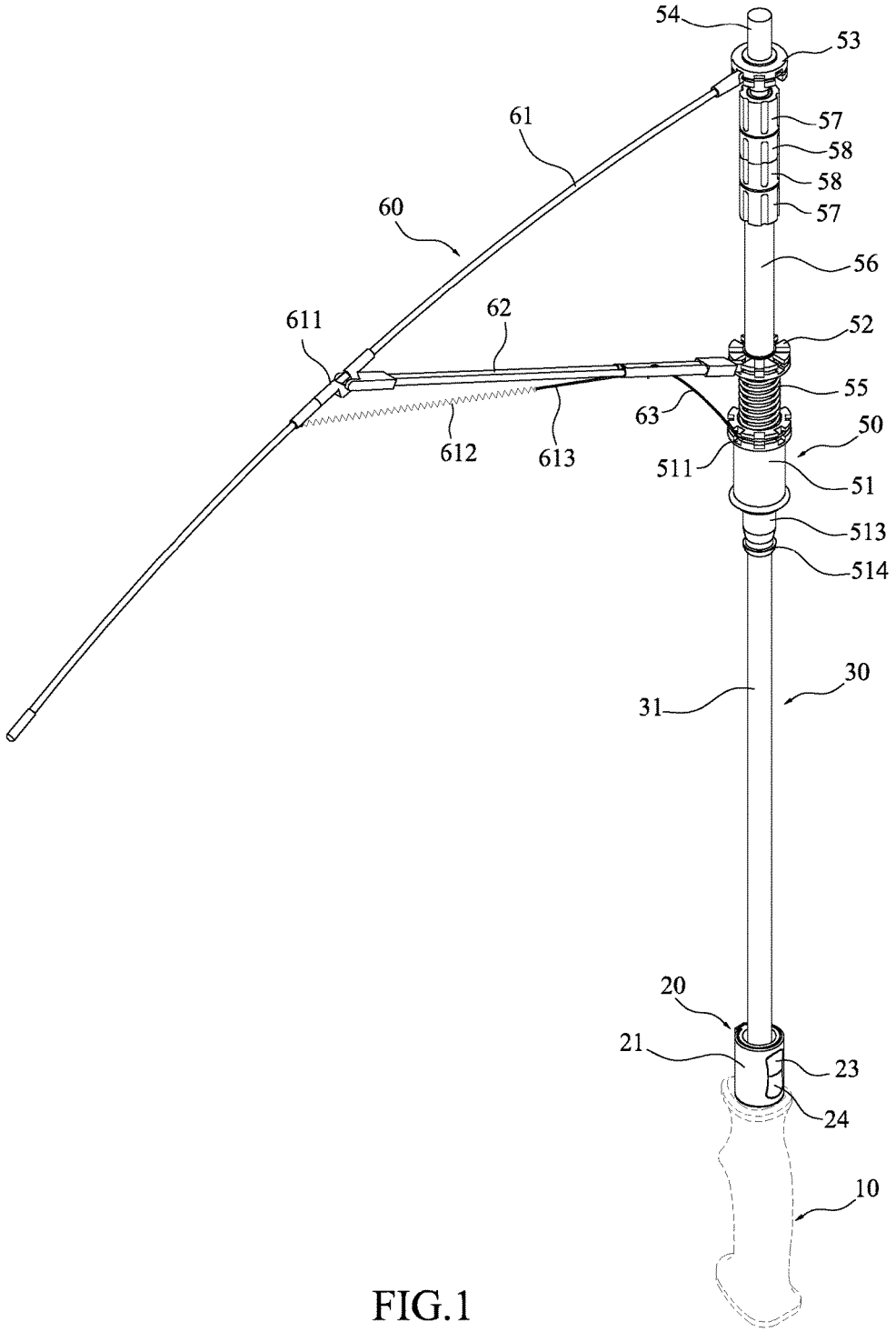
FIG. 1 is a perspective view of a portion of skeleton of an automatic non-collapsible umbrella according to a first preferred embodiment of the invention.
Figure 2:
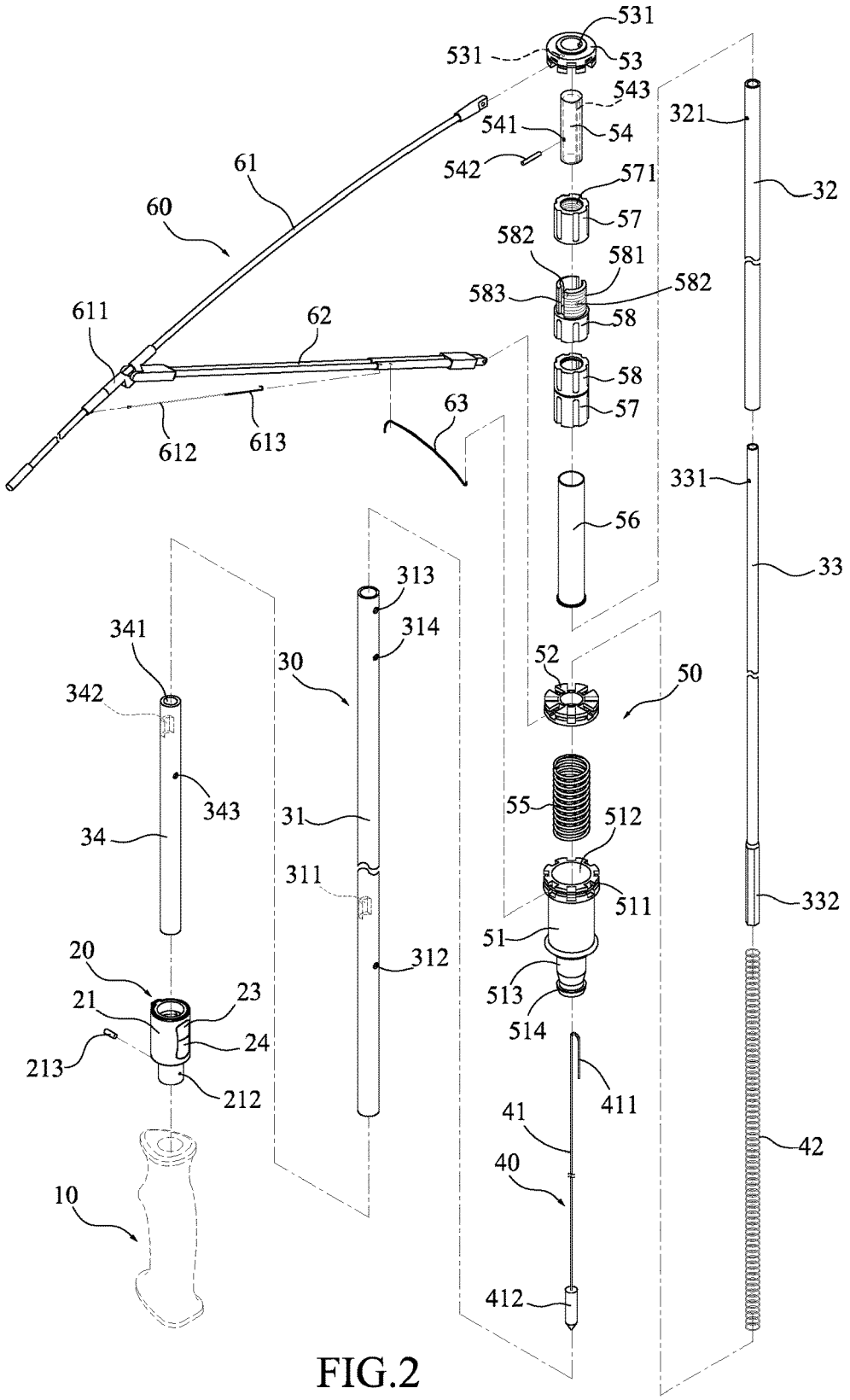
FIG. 2 is an exploded view of FIG. 1.
Figure 3A:
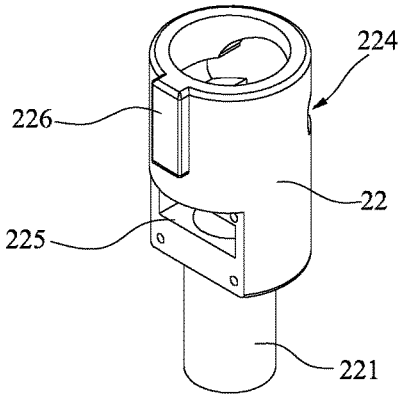
FIG. 3A is an enlarged, perspective view of the control mechanism of FIG. 2 but viewed from a different angle.
Figure 3:
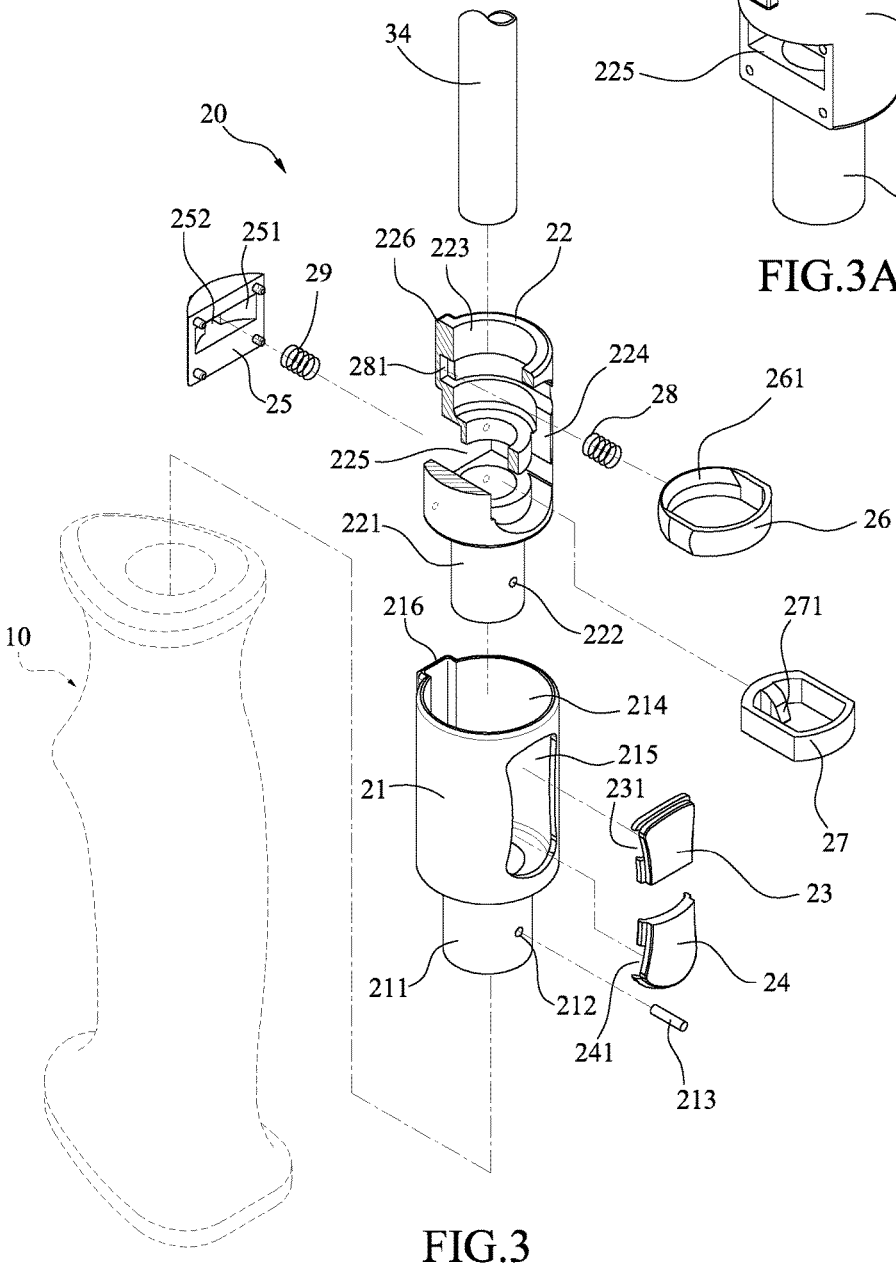
FIG. 3 is an exploded view of the control mechanism of FIG. 2.
Figures 4, 4A, 4B:
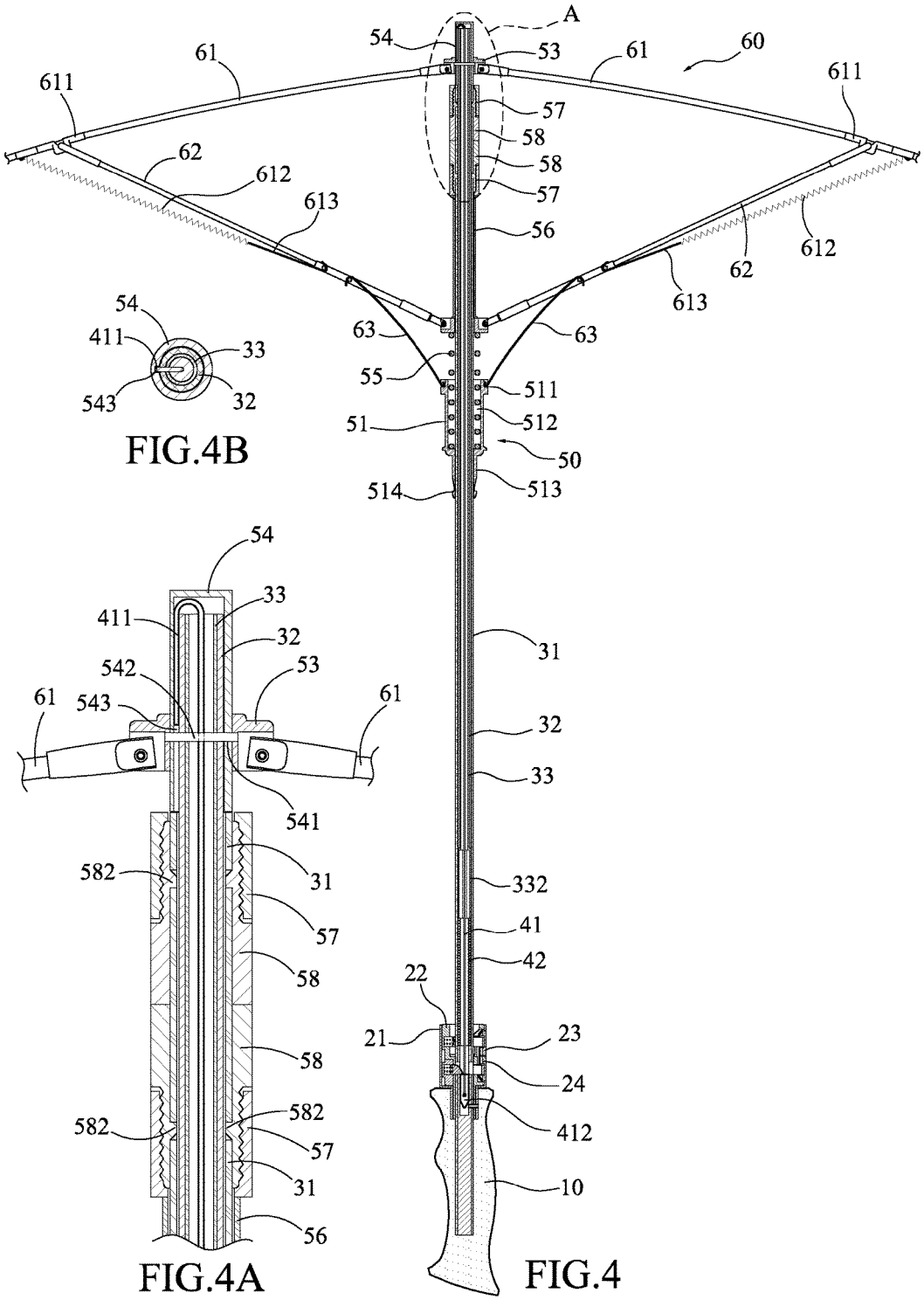
FIG. 4 is a side elevation of the skeleton of the umbrella being open.
FIG. 4A is a detailed view of the area in circle A of FIG. 4.
FIG. 4B is a sectional view of an upper portion of FIG. 4A.
Figure 5:
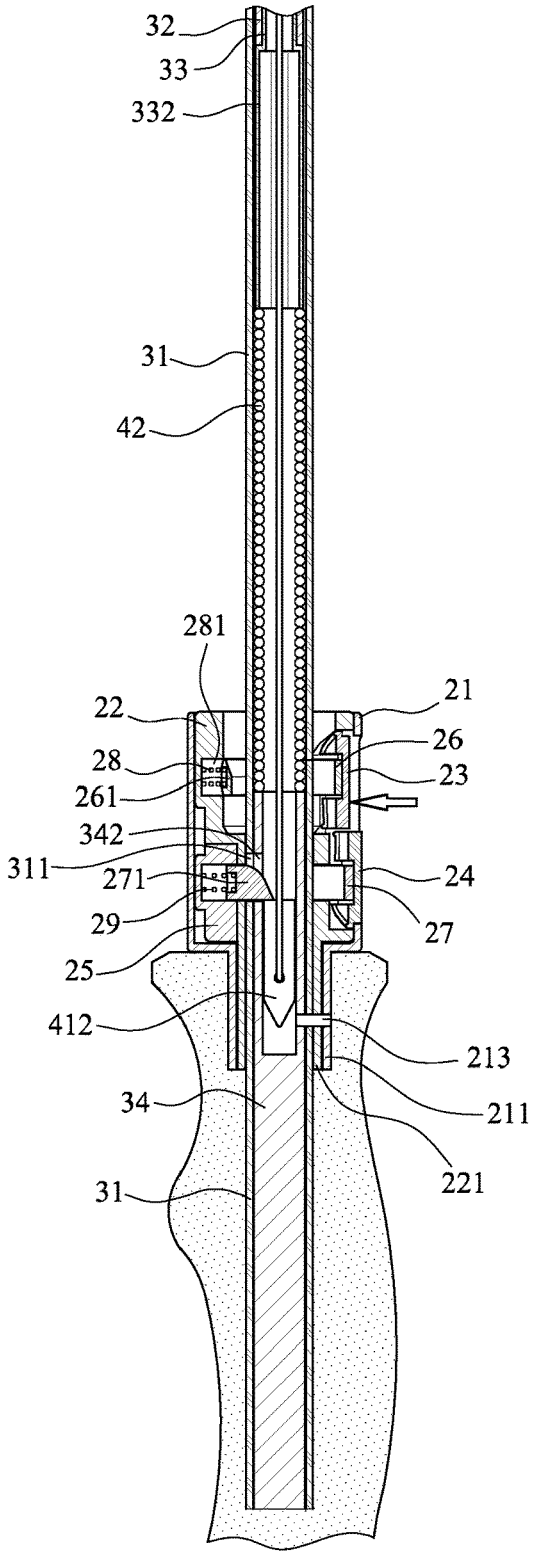
FIG. 5 is an enlarged view of a lower portion of FIG. 4.

Referring to FIGS. 1 to 8, an automatic non-collapsible umbrella in accordance with a first preferred embodiment of the invention comprises a handle 10, a control mechanism 20, a center post 30, a detent mechanism 40, a runner assembly 50 and a skeleton 60 as discussed in detail below.

A top of the handle 10 is provided with the control mechanism 20 which has a top with the center post 30 extending therefrom.

The control mechanism 20 includes a cylindrical main seat 21, a cylindrical control seat 22, an open button 23 for opening the umbrella, and a second collapse button 24 for closing the umbrella. The main seat 21 includes a cylindrical bottom extension 211 having a decreased diameter, an aperture 212 on a circumferential surface of the bottom extension 211, a space 214 defined by the main seat 21 and communicating with the bottom extension 211, a window 215 on a circumferential surface of the main seat 21, and a longitudinal groove 216 on the circumferential surface of the main seat 21 and opposing the window 215. The cylindrical control seat 22 includes a cylindrical bottom extension 221 having a decrease diameter, an aperture 222 on a circumferential surface of the bottom extension 221, a space 223 defined by the cylindrical control seat 22 and communicating with the bottom extension 221, a front opening 224 on a circumferential surface of the cylindrical control seat 22, a rear opening 225 disposed on a recess of the circumferential surface of the cylindrical control seat 22 and opposing the front opening 224, and a longitudinal projection 226 on the circumferential surface of the cylindrical control seat 22 and above the rear opening 225.

The control mechanism 20 further comprises a mount member 25 disposed onto the rear opening 225. The mount member 25 includes a recess 251 on an inner surface, and a receptacle 252 in the recess 251. The control mechanism 20 further comprises a biasing member 29 having one end anchored in the receptacle 252. An upper resistance member 26 is disposed above the rear opening 225. A torsion spring 28 has one end anchored in a receptacle 281 on the inner surface of the cylindrical control seat 22, and the other end urging against the upper resistance member 26. A lower resistance member 27 is disposed in the rear opening 225 and includes a protrusion 271 on an inner surface. The other end of the biasing member 29 urges against the lower resistance member 27 and is spaced from the protrusion 271.

The control mechanism 20 further comprises an open button 23 including a groove 231 on an inner surface and mounted on an upper portion of the window 215, and a collapse button 24 including a groove 241 on an inner surface and mounted on a lower portion of the window 215. A portion of the upper resistance member 26 urges against the groove 231 and a portion of the lower resistance member 27 urges against the groove 241. The cylindrical control seat 22 is disposed in the space 214 and the bottom extension 221 is disposed in the bottom extension 211. The longitudinal projection 226 is complimentarily disposed in the longitudinal groove 216.

The center post 30 includes a support tube 31, an inner tube 32 having a diameter less than that of the support tube 31, an enhancement tube 33 having a diameter less than that of both the support tube 31 and the inner tube 32, and a rod 34. The support tube 31 includes an opening 311 on a circumferential surface, an aperture 312 below the opening 311 and aligned with the apertures 212 and 222, a first upper aperture 313, and a second upper aperture 314 below the first upper aperture 313. The rod 34 is fastened in a lower portion of the support tube 31 and includes a top hole 341, an opening 342 aligned with the opening 311 and communicating with the top hole 341, and an aperture 343 below the opening 342 and aligned with the apertures 212, 222 and 312. The enhancement tube 33 is disposed in an intermediate portion of the support tube 31 and includes an upper aperture 331 and a lower enlargement 332 having a multiple-sided section. The inner tube 32 is put on the enhancement tube 33 and has its bottom supported by the enlargement 332. The inner tube 32 includes an upper aperture 321 aligned with the upper aperture 331.

The detent mechanism 40 includes a metal rod member 41 having an inverted U-shaped hook 411 on a top and a bottom enlargement 412; and a collapse biasing member 42. The hook 411 passes through the inner tube 32 and the enhancement tube 33 to fasten at tops of both the inner tube 32 and the enhancement tube 33. The bottom enlargement 412 is disposed in the top hole 341 of the rod 34. The protrusion 271 passes through the opening 311 of the support tube 31 and the opening 342 of the rod 34 to rest on a joining portion of the bottom enlargement 412 and the rod member 411 to secure the protrusion 271 (i.e., the lower resistance member 27), the support tube 31, the rod 34, and the rod member 41 together. The collapse biasing member 42 has an outer diameter substantially matched to an inner diameter of the support tube 31 so as to dispose in the support tube 31. The collapse biasing member 42 has a top urging against a bottom of the bottom enlargement 332 and a bottom urging against a top of the rod 34.

The runner assembly 50 includes a lower sleeve seat 51, a slotted intermediate ring 52, a top grommet 53, a hollow, cylindrical extension 54, a stretch biasing member 55 and a sleeve 56. The sleeve seat 51 is slidably put on the support tube 31 and includes a slotted ring 511 on a top, an axial channel 512, a lower reduced section 513, and an annular flange 514 on a bottom, the flange 514 disposed in the space 223 to be fastened in the upper resistance member 26. The slotted intermediate ring 52 is slidably put on the support tube 31 and has a top urging against the sleeve 56 and a bottom urging against the stretch biasing member 55. The slotted grommet 53 includes two opposite apertures 531 aligned with the apertures 321, 331. The extension 54 includes an aperture 541 aligned with the apertures 321, 331 and 531 and a longitudinal groove 543 for anchoring the hook 411. A pin 542 is inserted through the apertures 541, 531, 321, and 331 to fasten the extension 54, the grommet 53, the inner tube 32, and the enhancement tube 33 together. The stretch biasing member 55 is put on the support tube 31 and has a top urging against a bottom of the intermediate ring 52 and a bottom urging against a bottom of the space 512. Thus, the intermediate ring 52 and the sleeve seat 51 are spring-activated. The sleeve 56 is put on an upper portion of the support tube 31.

The runner assembly 50 further comprises two first limit tubes 57 including internal threads 571, and two second limit tubes 58 including an externally threaded section 581, two opposite protuberances 582 on an inner surface of the externally threaded section 581, and two opposite slits 583. The externally threaded section 581 and the internal threads 571 are secured together of either pair of the first limit tube 57 and the second limit tube 58. Thus, the protuberances 582 of one pair of the first limit tube 57 and the second limit tube 58 are disposed in the first upper aperture 313 and the protuberances 582 of the other pair of the first limit tube 57 and the second limit tube 58 are disposed in the second upper aperture 314. The first limit tube 57, the second limit tube 58, and the support tube 31 are fastened together. The lower pair of the first limit tube 57 and the second limit tube 58 is rested upon a top of the sleeve 56. A pin 213 is inserted through the apertures 212, 222, 312, and 343 to fasten the bottom extension 211 of the main seat 21, the bottom extension 221 of the cylindrical control seat 22, the support tube 31 and the rod 34 together.

The skeleton 60 includes a plurality of ribs 61, a plurality of primary stretchers 62 and a plurality of secondary stretchers 63. The rib 61 has one end pivotably attached to the grommet 53 and includes an intermediate connecting member 611. The primary stretcher 62 has one end pivotably attached to the intermediate ring 52 and the other end pivotably attached to the connecting member 611. Thus, the ribs 61 and the primary stretchers 62 are pivotably secured together. The secondary stretcher 63 has one pivotably attached to the slotted ring 511 and the other end pivotably attached to a portion of the primary stretcher 62 proximate the intermediate ring 52. A plurality of adjustment rods 613 each have one pivotably attached to a joining portion of the primary stretcher 62 and the secondary stretcher 63. A plurality of auxiliary springs 612 each have one end attached to a lower end of the connecting member 611 and the other end attached to the other end of the adjustment rod 613. The auxiliary spring 612 can exert an elastic force on the rib 61. The elastic force can be adjusted by increasing or decreasing the length of the adjustment rod 613. A canopy (not shown) is provided onto the ribs 61.

Figure 7:
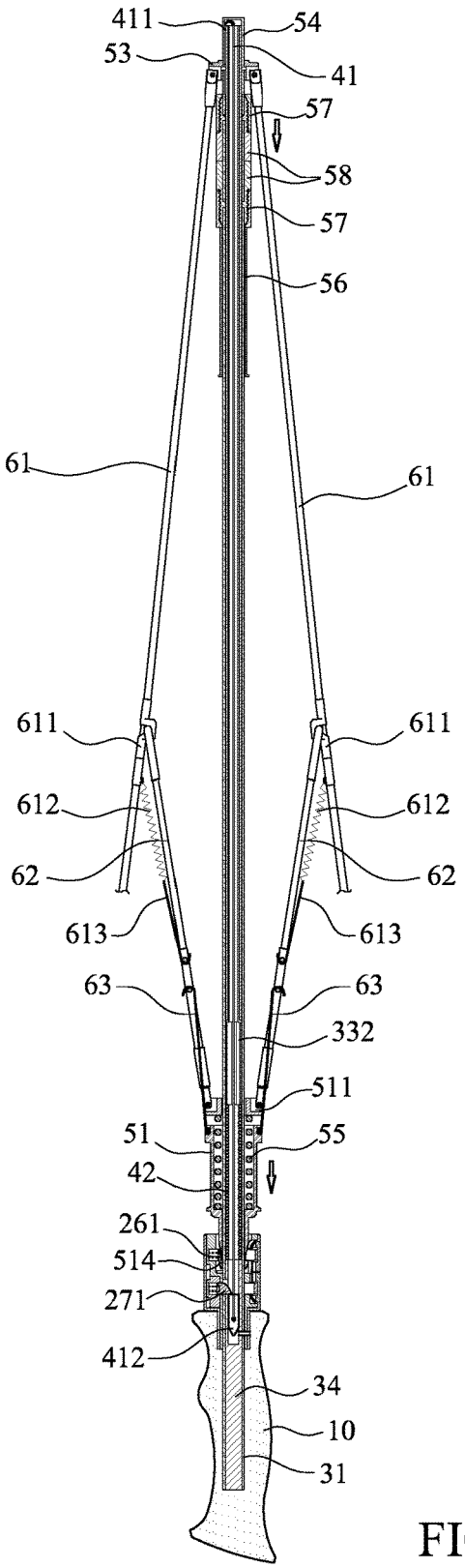
FIG. 7 is a view similar to FIG. 6 with the skeleton being fully collapsed.
Figure 7A:
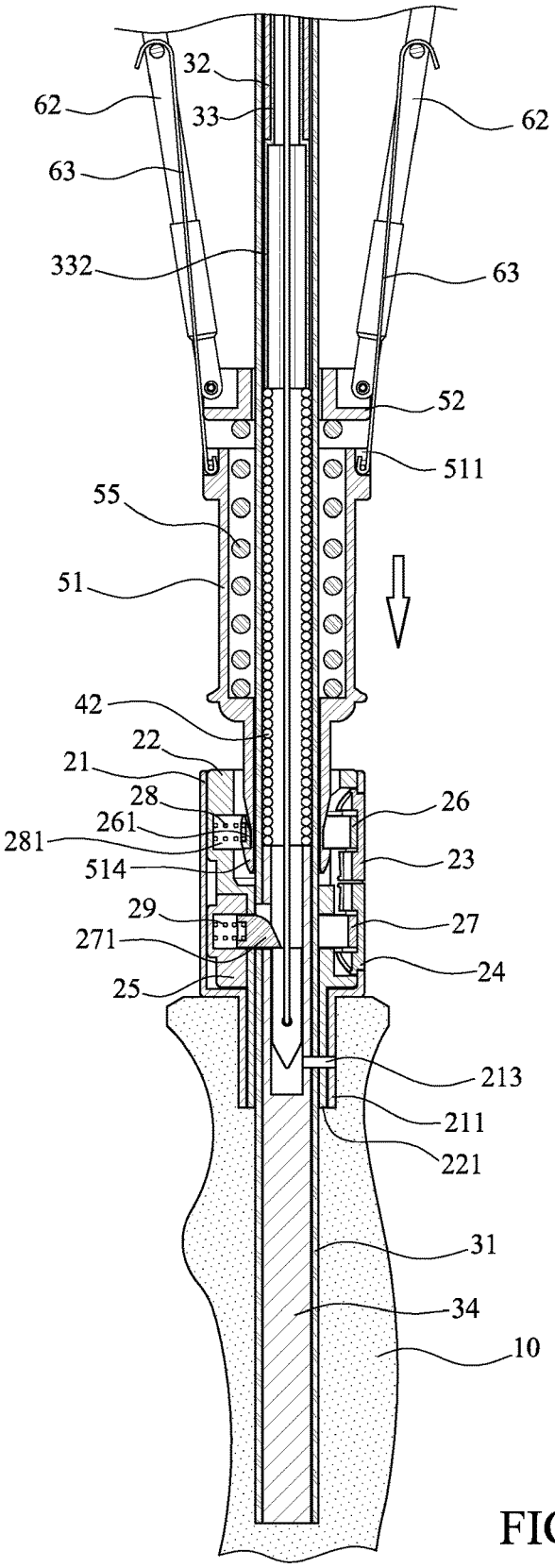
FIG. 7A is an enlarged view of a lower portion of FIG. 7.
Figure 8:
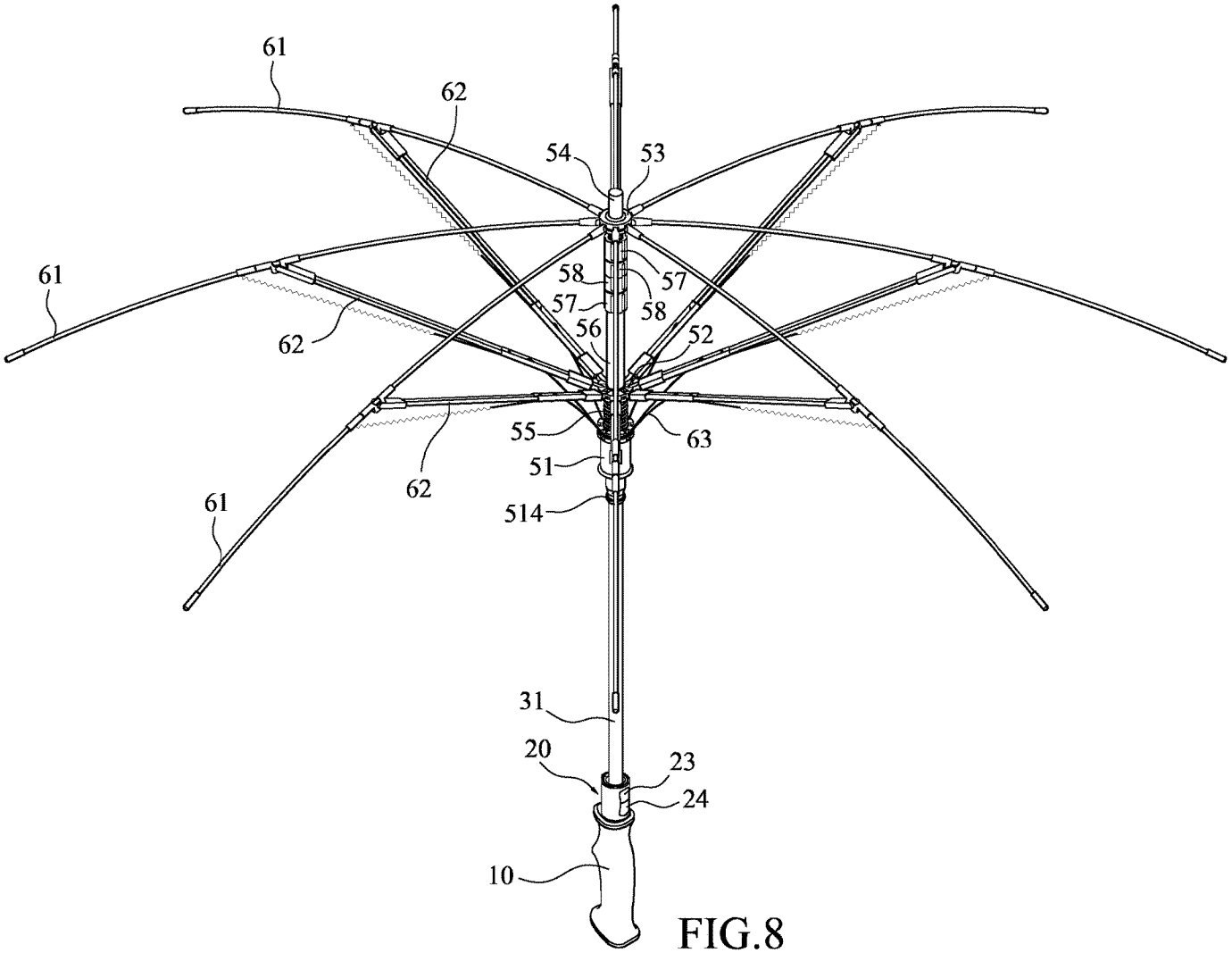
FIG. 8 is a perspective view of the skeleton of the umbrella being fully open.

As shown in FIGS. 7 and 7A, in a closed condition of the umbrella, the stretch biasing member 55 is compressed to dispose in the channel 512 and has an upper end urging against the intermediate ring 52. The annular flange 514 of the sleeve seat 51 is stopped by a curved section 261 of the upper resistance member 26. The collapse biasing member 42 is compressed between the lower enlargement 332 of the enhancement tube 33 and a top of the rod 34. For automatically opening the umbrella (see FIG. 5), a user may press the open button 23 to push the upper resistance member 26 inward to cause the curved section 261 of the upper resistance member 26 to unblock the annular flange 514 of the sleeve seat 51. Thus, the stored elastic force of the stretch biasing member 55 is released but the bottom enlargement 412 is stilled blocked by the protrusion 271 of the lower resistance member 27 and the tops of the inner tube 32 and the enhancement tube 33 are fastened by the hook 411 of the rod member 41. Thus, the bottom enlargement 412 remains stationary. The released stored elastic force of the stretch biasing member 55 pushes the sleeve seat 51 and the intermediate ring 52 further apart. Further, the upward moving intermediate ring 52 pushes the primary stretchers 62 upward and outward. And in turn, the ribs 61 are being collapsible, and together the sleeve 56 and the first and second limit members 57 and 58 move upward until the umbrella is fully open (see FIGS. 1, 4 and 8). In the open condition, the auxiliary springs 612 are expanded to store elastic energy to be used for umbrella closing purpose.

Figure 6:
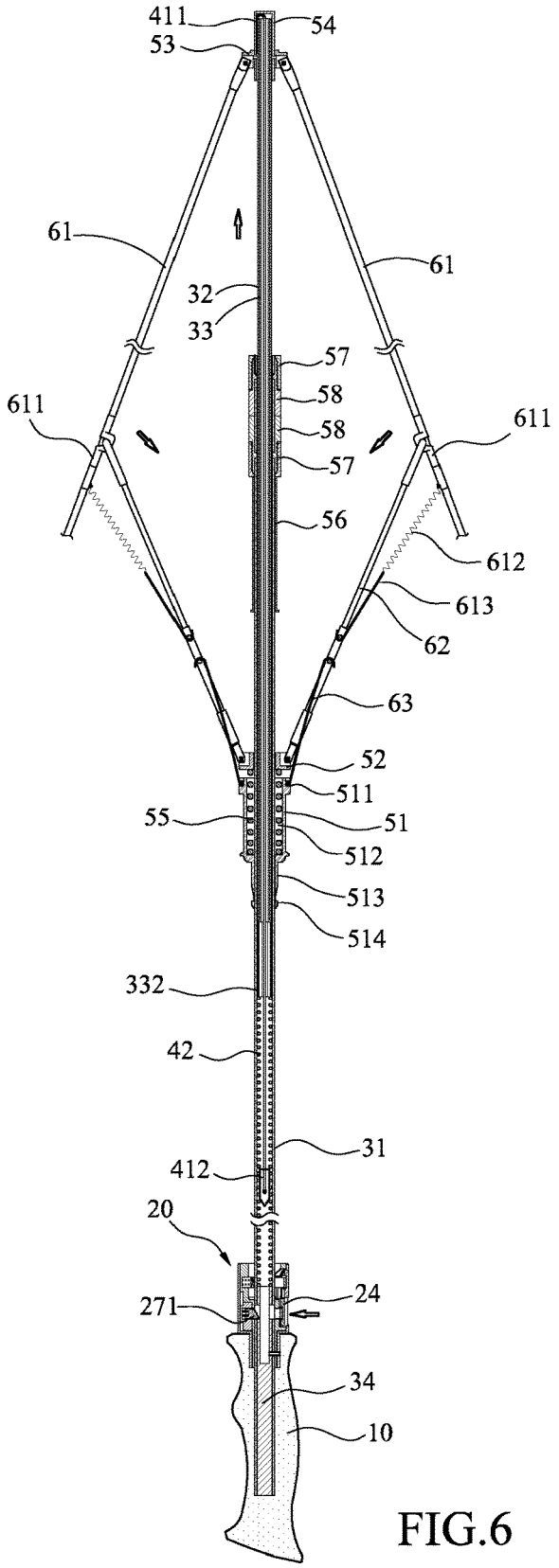
FIG. 6 is a view similar to FIG. 4 but the skeleton being collapsed.
Figure 6A:
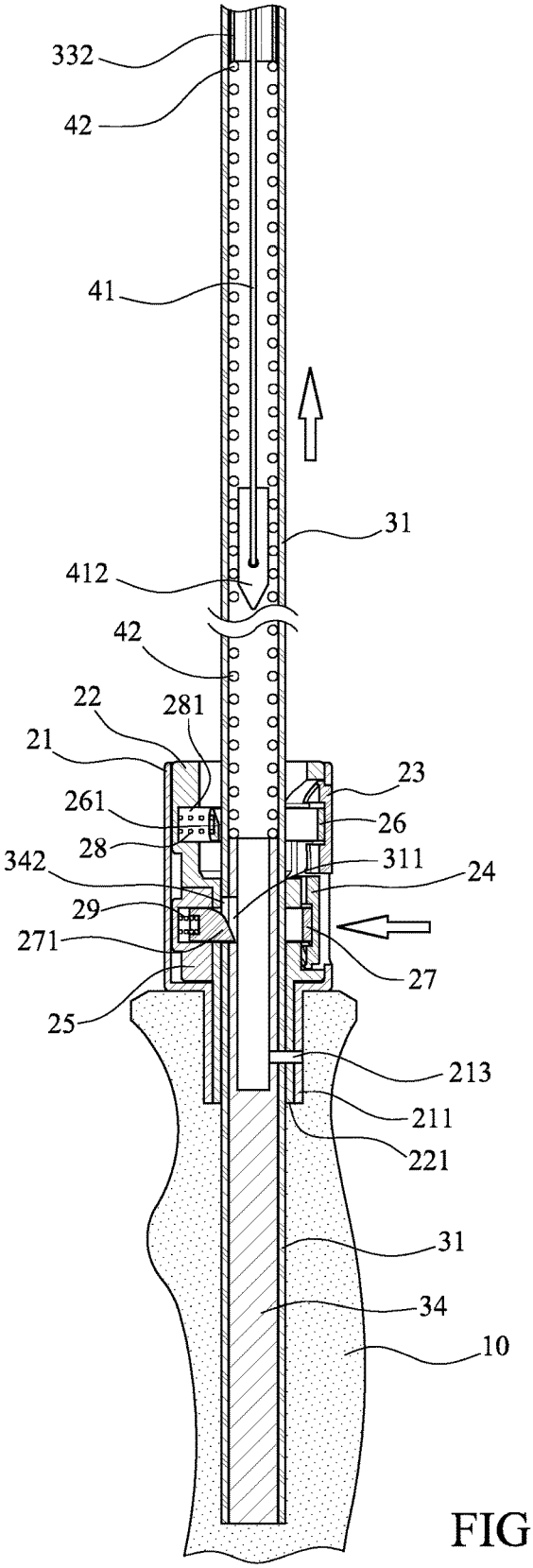
FIG. 6A is an enlarged view of a lower portion of FIG. 6.

As shown in FIGS. 6 and 6A, an umbrella closing operation is described. The user may press the collapse button 24 to push the lower resistance member 27 inward to cause the protrusion 271 of the lower resistance member 27 to unblock the bottom enlargement 412. Thus, the stored elastic force of the collapse biasing member 42 is released and the top of the collapse biasing member 42 urges against and pushes up the lower enlargement 332 of the enhancement tube 33. And in turn, the enhancement tube 33, the inner tube 32, the extension 54 and the grommet 53 move upward and both the ribs 61 and the primary stretchers 62 are being collapsible. Also, the auxiliary springs 612 are compressed. Both the sleeve seat 51 and the intermediate ring 52 move downward until being stopped. This finishes the umbrella closing operation (see FIG. 7). The annular flange 514 of the sleeve seat 51 is stopped by the curved section 261 of the upper resistance member 26, and the bottom enlargement 412 of the rod member 41 is stopped by the protrusion 271 of the lower resistance member 27. Further, both the collapse biasing member 42 and the second helical spring stretch biasing member 55 are compressed to store elastic energy to be used for umbrella opening purpose (see FIGS. 7 and 7A).

The collapse biasing member 42 has an elastic force greater than that of the second helical spring stretch biasing member 55. Alternatively, the sum of the elastic force of the collapse biasing member 42 and the elastic force of the auxiliary springs 612 is greater than that of the stretch biasing member 55. Both designs are for the purpose of facilitating closing or opening of the umbrella.

Figure 9:
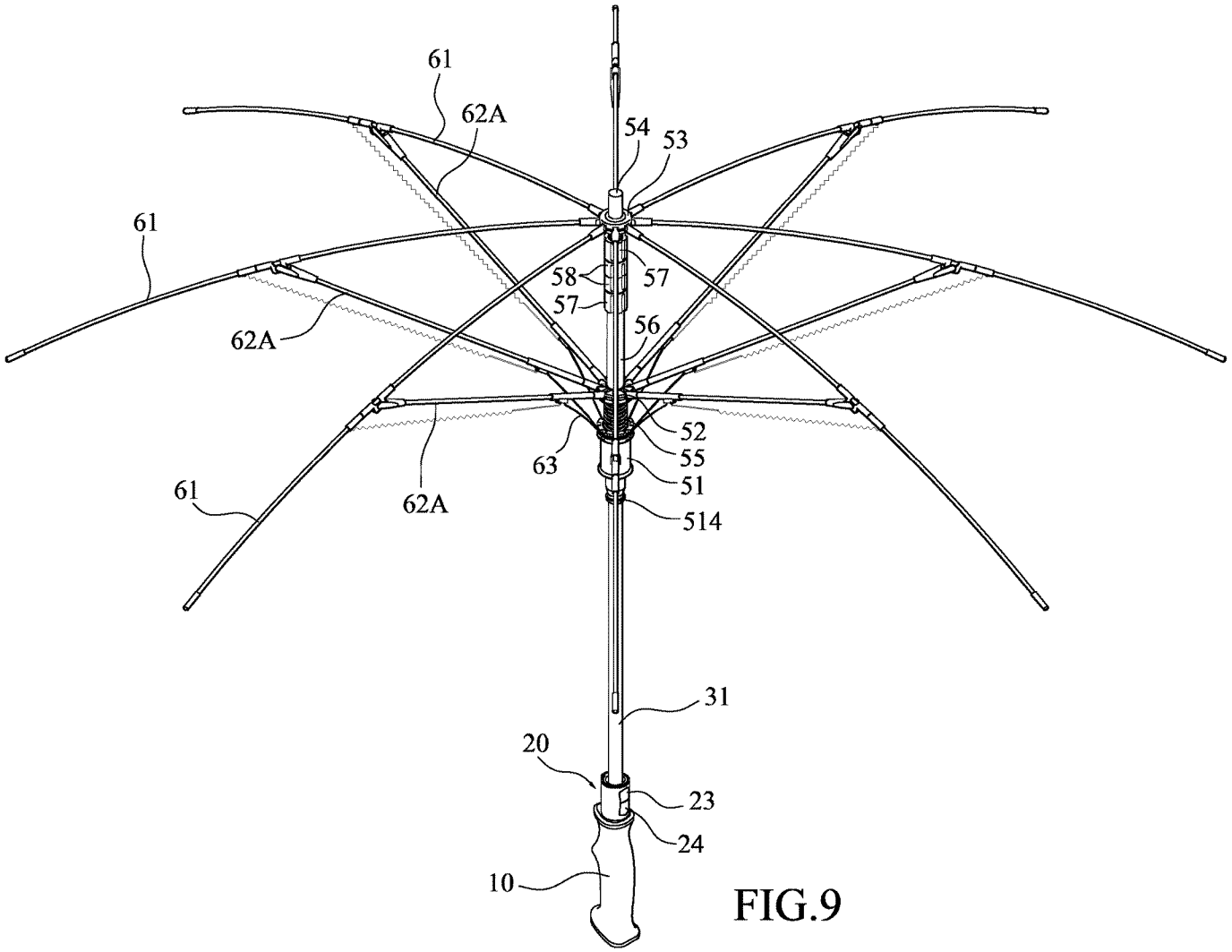
FIG. 9 is a perspective view of skeleton of an automatic non-collapsible umbrella according to a second preferred embodiment of the invention, the skeleton being fully open.
Figure 10:
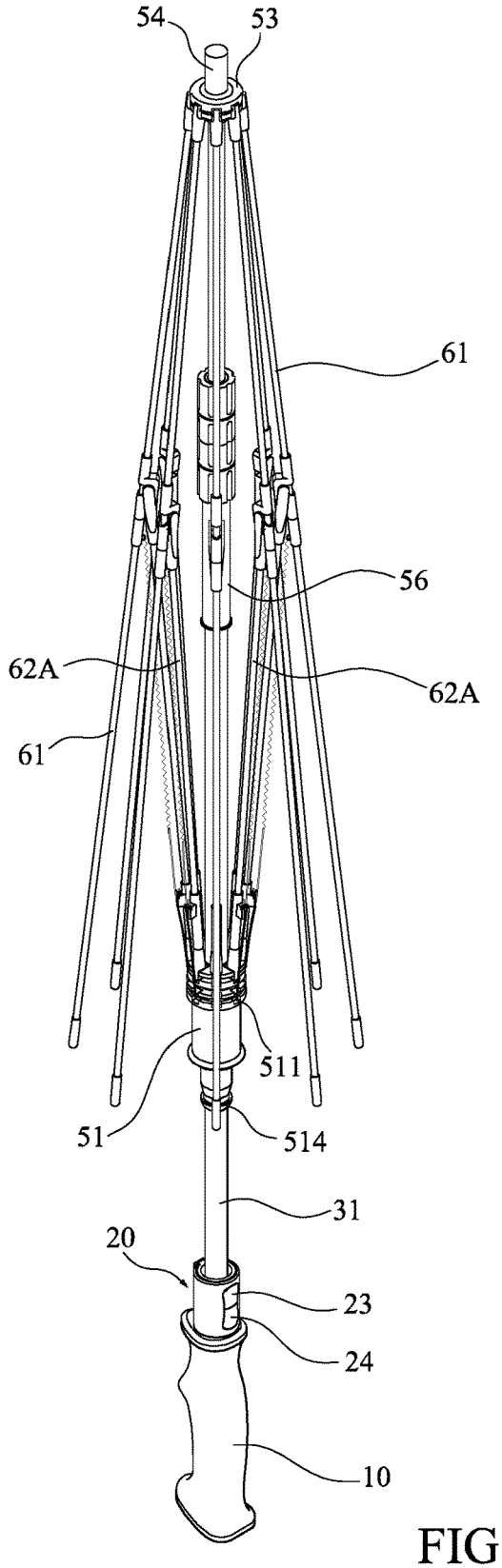
FIG. 10 is a perspective view of the skeleton being fully collapsed.
Figure 11:
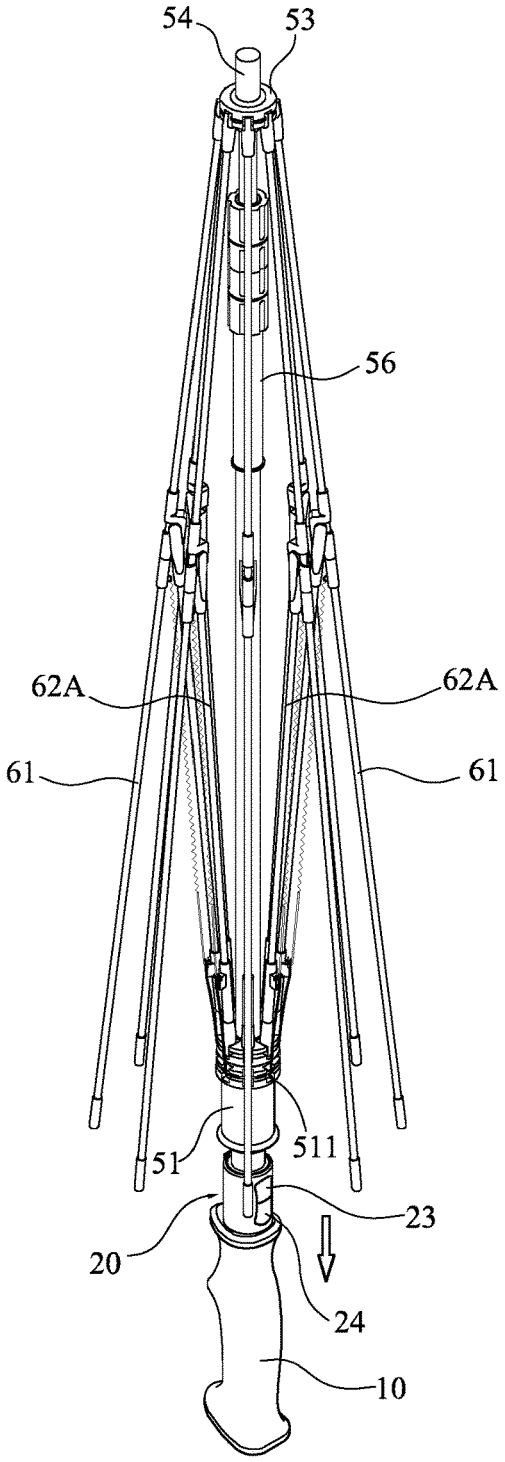
FIG. 11 is a view similar to FIG. 10 showing the skeleton being pushed downward for being further collapsed.

Referring to FIGS. 9 to 11, an automatic non-collapsible umbrella in accordance with a second preferred embodiment of the invention is shown. The characteristics of the second preferred embodiment are substantially the same as that of the first preferred embodiment except the following: The primary stretchers are embodied as double stretchers 62A. Alternatively, single stretchers 62A are made possible. Both the support tube 31 and the inner tube 32 are made of fiberglass reinforced plastics (FRP).

Figure 12:
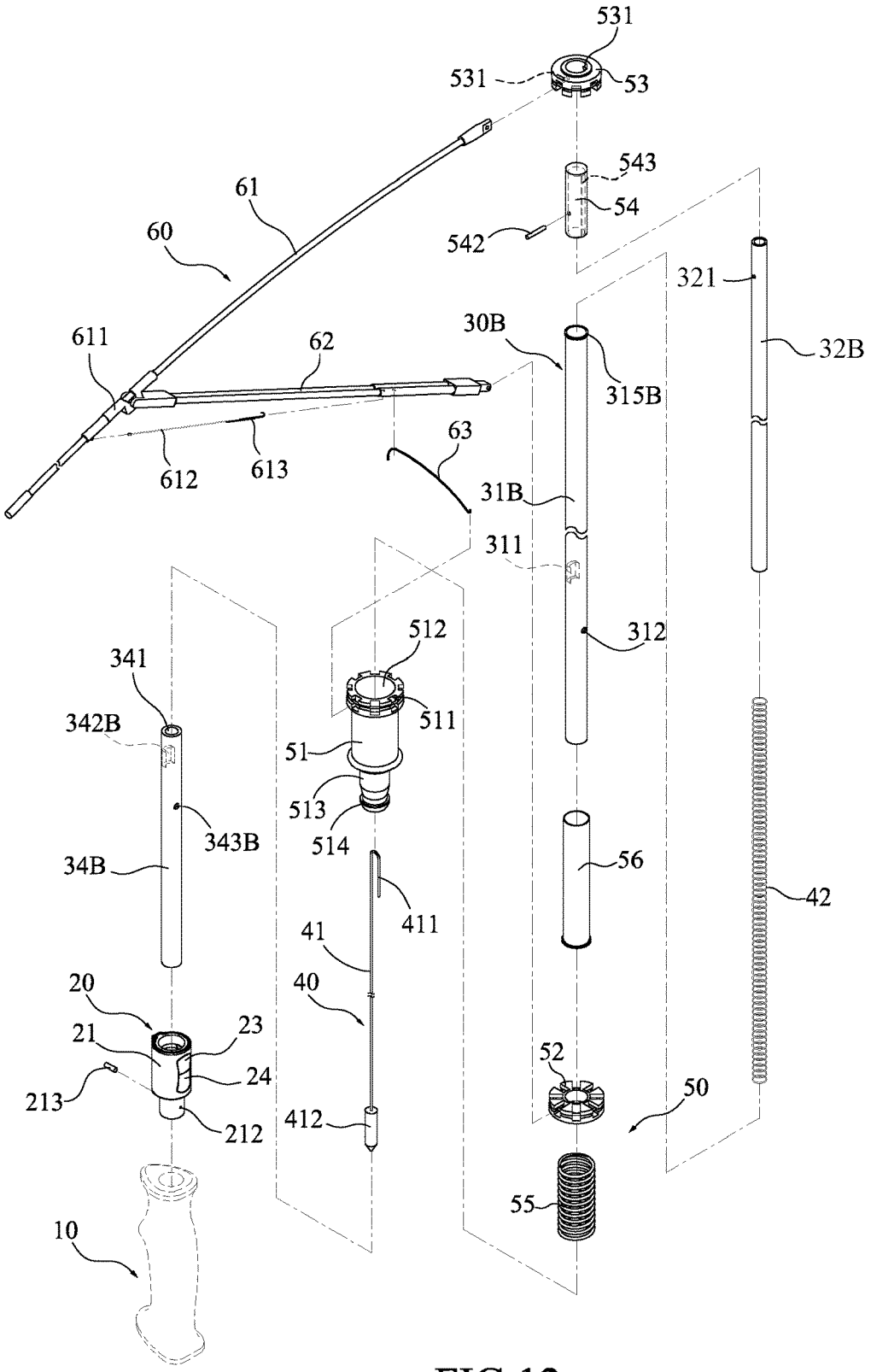
FIG. 12 is an exploded view of skeleton of an automatic non-collapsible umbrella according to a third preferred embodiment of the invention.

Referring to FIG. 12, an automatic non-collapsible umbrella in accordance with a third preferred embodiment of the invention is shown. The characteristics of the third preferred embodiment are substantially the same as that of the first preferred embodiment except the following: Materials of the components are metal. An annular flange 315B is provided on a top of a support tube 31B. The provision of the annular flange 315B eliminates the provision of the first and second limit members 57 and 58. Further, the enhancement tube 33 is eliminated. The collapse biasing member 42 is disposed in the support tube 31B and has a top urging against a bottom of the inner tube 32B and a bottom urging against a top of a tubular member 34B which serves as a replacement of the rod.

The invention has the following characteristics and advantages:

The stretch biasing member 55 is put on the support tube 31 or 31B, the collapse biasing member 42 is provided in the support 31 or 31B, and the collapse biasing member 42 and the stretch biasing member 55 are independent so that the elastic force of each of the collapse biasing member 42 and the second stretch biasing member 55 can be decreased to a minimum without compromising the characteristics of the invention.

Further, the collapse biasing member 42 has an outer diameter generally matched to an inner diameter of the support tube 31 or 31B so as to dispose in the support tube 31 or 31B. This ensures that the collapse biasing member 42 can operate normally for a long period of time without being oblique. It facilitates the opening or closing operation of the umbrella. In addition, the first-open button 23 for opening the umbrella and the collapse button 24 for closing the umbrella are operated independently. Thus, the probability of malfunction is decreased to a minimum.

In addition to the collapse biasing member 42, the auxiliary springs 612 are provided to increase elastic force required for closing the umbrella. Therefore, the closing or opening of the umbrella can be made easy and safer.

While the invention has been described in terms of preferred embodiments, those skilled in the art will recognize that the invention can be practiced with modifications within the spirit and scope of the appended claims.

What is claimed is:

1. An automatic non-collapsible umbrella comprising a center post (30), a runner assembly (50) mounted on the center post (30) and including a lower sleeve seat (51), a slotted intermediate ring (52), and a top grommet (53), and a skeleton (60) mounted on the runner assembly (50), wherein the center post (30) includes a support tube (31) with a control mechanism (20) mounted thereon, the control mechanism (20) including a cylindrical main seat (21) and a cylindrical control seat (22), the support tube (31) further with a detent mechanism (40) mounted thereon, the detent mechanism (40) including a rod member (41) and a collapse biasing member (42);

the runner assembly (50) further includes a stretch biasing member (55) biased between the lower sleeve seat (51) and the slotted intermediate ring (52);

the cylindrical control seat (22) includes a front opening (224) on a circumferential surface, and a rear opening (225) disposed on the circumferential surface with a mount member (25) disposed thereon;

the cylindrical main seat (21) includes a window (215) on a circumferential surface and corresponding to the front opening (224), an open button (23) in the window (215) for opening the automatic non-collapsible umbrella, and a collapse button (24) in the window (215) for closing the automatic non-collapsible umbrella;

the mount member (25) includes a recess (251) on an inner surface, and a receptacle (252) in the recess (251) with a biasing member (29) mounted therein wherein a lower resistance member (27) is disposed in the cylindrical control seat (22) to push the biasing member (29) rearward to urge against the receptacle (252), and the collapse button (24) is disposed on the lower resistance member (27);

the center post (30) further includes a rod (34) in the support tube (31);

the rod member (41) passes through an enhancement tube (33) to fasten at a top end of the enhancement tube (33);

a bottom end (412) of the rod member (41) passes through the lower resistance member (27) to dispose in the rod (34);

the collapse biasing member (42) has a top urging against a bottom of the enhancement tube (33) and a bottom urging against a top of the rod (34) so that the collapse biasing member (42) is biased between the enhancement tube (33) and the rod (34); and in an open state of the automatic non-collapsible umbrella in response to pressing the collapse button (24) to push the lower resistance member (27) inward to cause the lower resistance member (27) to unblock the rod member (41), the stored elastic force of the collapse biasing member (42) is released to urge its top against and push up the enhancement tube (33), and the top grommet (53) moves upward, thereby closing the skeleton (60).

2. The automatic non-collapsible umbrella of claim 1, wherein the support tube (31) includes an opening (311), the rod (34) includes a top hole (341) and an opening (342) aligned with the opening (311) and communicating with the top hole (341), the lower resistance member (27) includes a protrusion (271) on an inner surface urging the biasing member (29), and the protrusion (271) passes through the opening (311) of the support tube (31) and the opening (342) of the rod (34) to secure the lower resistance member (27), the support tube (31), the rod (34), and the rod member (41) together.

3. The automatic non-collapsible umbrella of claim 2, wherein the rod member (41) includes a bottom enlargement (412) disposed in the top hole (341) of the rod (34), and a top of the bottom enlargement (412) is stopped by the protrusion (271).

4. The automatic non-collapsible umbrella of claim 1, wherein the enhancement tube (33) includes a lower enlargement (332) urging against the collapse biasing member (42).

5. The automatic non-collapsible umbrella of claim 1, wherein the center post (30) further includes an inner tube (32) placed on the enhancement tube (33), the enhancement tube (33) includes a lower enlargement (332) with the inner tube (32) positioned thereon, and the rod member (41) includes an inverted U-shaped hook (411) on a top fastened at tops of both the inner tube (32) and the enhancement tube (33).

6. The automatic non-collapsible umbrella of claim 5, wherein the lower enlargement (332) has a multiple-sided section.

7. The automatic non-collapsible umbrella of claim 1, wherein the runner assembly (50) further includes an intermediate ring (52) and a hollow extension (54) atop of the enhancement tube (33) and placed on the top grommet (53); the skeleton (60) includes a plurality of ribs (61), a plurality of primary stretchers (62), and a plurality of secondary stretchers (63); the rib (61) has one end pivotably attached to the top grommet (53); the primary stretcher (62) has one end pivotably attached to the intermediate ring (52); and in response to moving the lower sleeve seat (51) downward, both the ribs (61) and the primary stretchers (62) pivotably move toward the center post (30).

8. The automatic non-collapsible umbrella of claim 7, wherein the rib (61) includes an intermediate connecting member (611), a plurality of adjustment rods (613) each having one pivotably attached to a joining portion of the primary stretcher (62) and the secondary stretcher (63), and a plurality of auxiliary biasing members (612) each having one end attached to a lower end of the connecting member (611) and the other end attached to the other end of the adjustment rod (613), the auxiliary biasing member (612) being configured to exert an elastic force on the rib (61); and wherein in response to moving the lower sleeve seat (51) downward, both the ribs (61) and the primary stretchers (62) pivotably move toward the center post (30) with the intermediate ring (52) moving downward and the auxiliary biasing members (612) being compressed.

9. An automatic non-collapsible umbrella comprising a center post (30), a runner assembly (50) mounted on the center post (30) and including a lower sleeve seat (51), a slotted intermediate ring (52), and a top grommet (53), and a skeleton (60) mounted on the runner assembly (50), wherein the center post (30) includes a support tube (31) with a control mechanism (20) mounted thereon, the control mechanism (20) including a cylindrical main seat (21) and a cylindrical control seat (22);

the runner assembly (50) further includes a stretch biasing member (55) biased between the lower sleeve seat (51) and the slotted intermediate ring (52);

the cylindrical control seat (22) includes a front opening (224) on a circumferential surface, and a rear opening (225) disposed on the circumferential surface with a mount member (25) disposed thereon;

the cylindrical main seat (21) includes a window (215) on a circumferential surface and corresponding to the front opening (224), an open button (23) in the window (215) for opening the automatic non-collapsible umbrella;

the cylindrical control seat (22) further includes the front opening (224) on a circumferential surface, a biasing element (28) having one end anchored in a receptacle (281) on an inner surface of the cylindrical control seat (22), and the other end urging against an upper resistance member (26);

the lower sleeve seat (51) includes an annular flange (514) on a bottom, the annular flange (514) being stopped by the upper resistance member (26); and the open button (23) is secured to the upper resistance member (26);

in a closed state of the automatic non-collapsible umbrella in response to pressing the open button (23) to push the upper resistance member (26) inward to cause the upper resistance member (26) to unblock the annular flange (514), the stored elastic force of the stretch biasing member (55) is released to push the top grommet (53) and the slotted intermediate ring (52) further apart, thereby opening the skeleton (60).

10. The automatic non-collapsible umbrella of claim 9, further comprising two first limit tubes (57) between the top grommet (53) and the slotted intermediate ring (52), and an annular flange (315B) provided on a top of a support tube (31B) for supporting the first limiting tubes (57) from below.

11. The automatic non-collapsible umbrella of claim 9, wherein the skeleton (60) includes a plurality of ribs (61), a plurality of primary stretchers (62), and a plurality of secondary stretchers (63); the rib (61) has one end pivotably attached to the top grommet (53); the primary stretcher (62) has one end pivotably attached to the intermediate ring (52); and in response to moving the lower sleeve seat (51) upward, both the ribs (61) and the primary stretchers (62) pivotably move away from the center post (30).

12. The automatic non-collapsible umbrella of claim 11, further comprising two sets of first and second limit tubes (57, 58) between the top grommet (53) and the slotted intermediate ring (52).

13. The automatic non-collapsible umbrella of claim 11, wherein the rib (61) includes an intermediate connecting member (611), a plurality of adjustment rods (613) each having one pivotably attached to a joining portion of the primary stretcher (62) and the secondary stretcher (63), and a plurality of auxiliary biasing members (612) each having one end attached to a lower end of the connecting member (611) and the other end attached to the other end of the adjustment rod (613), the auxiliary biasing member (612) being configured to exert an elastic force on the rib (61); and wherein in response to pivotably moving the ribs (61) away from the center post (30) the auxiliary biasing members (612) are expanded.

14. The automatic non-collapsible umbrella of claim 9, wherein the main seat (21) includes a longitudinal groove (216) on a circumferential surface of the main seat (21), the cylindrical control seat (22) includes a longitudinal projection (226) on the circumferential surface of the cylindrical control seat (22), and the longitudinal projection (226) is fitted in the longitudinal groove (216) to fasten the cylindrical control seat (22) and the main seat (21) together.

15. The automatic non-collapsible umbrella of claim 9, wherein the main seat (21) includes a cylindrical bottom extension (211) having a decreased diameter, and a pin (213); the cylindrical control seat (22) includes a cylindrical bottom extension (221) having a decrease diameter; the support tube (31) has a lower portion inserted into the cylindrical control seat (22) which is disposed in the main seat (21); and the pin (213) is inserted through the main seat (21), the cylindrical control seat (22), the support tube (31), and the rod (34) to fasten them together in a handle (10).

16. An automatic non-collapsible umbrella comprising a center post (30), a runner assembly (50) mounted on the center post (30) and including a lower sleeve seat (51), a slotted intermediate ring (52), and a top grommet (53), and a skeleton (60) mounted on the runner assembly (50), wherein the center post (30) includes a support tube (31) with a control mechanism (20) mounted thereon, the control mechanism (20) including a cylindrical main seat (21), a cylindrical control seat (22), an open button (23) for opening the automatic non-collapsible umbrella, a collapse button (24) closing the automatic non-collapsible umbrella, an upper resistance member (26) secured to the open button (23), and a lower resistance member (27) secured to the collapse button (24);

the support tube (31) is further provided with a detent mechanism (40) mounted thereon;

the detent mechanism (40) includes a rod member (41) and a collapse biasing member (42), the rod member (41) disposed through the support tube (31) and the collapse biasing member (42) and further through the lower resistance member (27) with the collapse biasing member (42) biased in the support tuber (31);

the runner assembly (50) further includes a stretch biasing member (55) biased between the lower sleeve seat (51) and the slotted intermediate ring (52), and an annular flange (514) on a bottom, the annular flange (514) being fastened in the upper resistance member (26);

in a closed state of the automatic non-collapsible umbrella in response to pressing the open button (23) to push the upper resistance member (26) inward to unblock the lower sleeve seat (51), the stored elastic force of the stretch biasing member (55) is released to push the lower sleeve seat (51) further away from the slotted intermediate ring (52), thereby opening the skeleton (60); and in an open state of the automatic non-collapsible umbrella in response to pressing the collapse button (24) to push the lower resistance member (27) inward to cause the lower resistance member (27) to unblock the rod member (41), the stored elastic force of the collapse biasing member (42) is released to urge its top against and pushes up an enhancement tube (33), and the top grommet (53) moves upward, thereby closing the skeleton (60).

17. The automatic non-collapsible umbrella of claim 16, wherein the stretch biasing member (55) is put on the support tube (31), the collapse biasing member (42) is disposed in the support tube (31), and the stretch biasing member (55) and the collapse biasing member (42) operate independently so that required force to open or close the automatic non-collapsible umbrella is decreased to a minimum.

18. The automatic non-collapsible umbrella of claim 16, wherein an outer diameter of the collapse biasing member (42) is substantially matched to an inner diameter of the support tube (31).

19. The automatic non-collapsible umbrella of claim 16, wherein the runner assembly (50) further includes the intermediate ring (52) and a hollow extension (54) atop of the enhancement tube (33) and placed on the top grommet (53); the skeleton (60) includes a plurality of ribs (61), a plurality of primary stretchers (62), and a plurality of secondary stretchers (63); the rib (61) has one end pivotably attached to the top grommet (53); the primary stretcher (62) has one end pivotably attached to the intermediate ring (52); the rib (61) includes an intermediate connecting member (611), a plurality of adjustment rods (613) each having one end pivotably attached to a joining portion of the primary stretcher (62) and the secondary stretcher (63), and a plurality of auxiliary biasing members (612) each having one end attached to a lower end of the connecting member (611) and the other end attached to the other end of the adjustment rod (613), the auxiliary biasing member (612) being configured to exert an elastic force on the rib (61); and in response to moving the lower sleeve seat (51) downward, both the ribs (61) and the primary stretchers (62) pivotably move toward the center post (30) with the intermediate ring (52) moving downward and the auxiliary biasing members (612) being compressed.

* * * * *